US011619180B2

(12) United States Patent
Roberts et al.

(10) Patent No.: US 11,619,180 B2
(45) Date of Patent: Apr. 4, 2023

(54) VALVE ACTUATION SYSTEM COMPRISING LOST MOTION AND HIGH LIFT TRANSFER COMPONENTS IN A MAIN MOTION LOAD PATH

(71) Applicant: Jacobs Vehicle Systems, Inc., Bloomfield, CT (US)

(72) Inventors: Gabriel S. Roberts, Wallingford, CT (US); Steven Benn, Storrs, CT (US); Dong Yang, West Hartford, CT (US); Eric Hodgkinson, New Hartford, CT (US); Dominick Guarna, Colebrook, CT (US)

(73) Assignee: Jacobs Vehicle Systems, Inc., Bloomfield, CT (US)

( * ) Notice: Subject to any disclaimer, the term of this patent is extended or adjusted under 35 U.S.C. 154(b) by 0 days.

(21) Appl. No.: 17/302,475

(22) Filed: May 4, 2021

(65) Prior Publication Data

US 2021/0340891 A1 Nov. 4, 2021

Related U.S. Application Data

(60) Provisional application No. 62/704,321, filed on May 4, 2020.

(51) Int. Cl.
*F02D 13/02* (2006.01)
*F01L 1/18* (2006.01)
(Continued)

(52) U.S. Cl.
CPC ..... *F02D 13/0207* (2013.01); *F01L 1/146* (2013.01); *F01L 1/18* (2013.01);
(Continued)

(58) Field of Classification Search
CPC ... F01L 1/146; F01L 1/18; F01L 1/181; F01L 1/185; F01L 2001/186; F01L 1/267;
(Continued)

(56) References Cited

U.S. PATENT DOCUMENTS 4,387,680 A 6/1983 Tsunetomi
6,845,433 B2 2/2005 Vanderpoel
(Continued)

FOREIGN PATENT DOCUMENTS

FR 2985541 A1 7/2013
KR 101338462 B1 12/2013

OTHER PUBLICATIONS

International Search Report for International Application No. PCT/IB2021/053757 dated Jul. 13, 2021, 4 pages.
(Continued)

*Primary Examiner* — Jorge L Leon, Jr.
(74) *Attorney, Agent, or Firm* — Moreno IP Law LLC

(57) ABSTRACT

A valve actuation system comprising a valve actuation motion source configured to provide a main event valve actuation motion to at least one engine valve via a main motion load path that comprises at least one valve train component. The valve actuation system further includes a lost motion component arranged within a first valve train component in the main motion load path, the lost motion component being controllable to operate in a motion conveying state or a motion absorbing state. The valve actuation system also comprises a high lift transfer component arranged in the main motion load path, with the high lift transfer component being configured to permit the main motion load path to convey at least a high lift portion of the main event valve actuation motion when the lost motion component is in the motion absorbing state.

16 Claims, 12 Drawing Sheets

(51) Int. Cl.
*F01L 1/14* (2006.01)
*F01L 1/46* (2006.01)
*F01L 13/00* (2006.01)
*F01L 1/26* (2006.01)

(52) U.S. Cl.
CPC ..... *F01L 1/46* (2013.01); *F01L 13/0005* (2013.01); *F01L 1/181* (2013.01); *F01L 1/185* (2013.01); *F01L 1/267* (2013.01); *F01L 2001/186* (2013.01); *F01L 2001/467* (2013.01); *F01L 2800/12* (2013.01)

(58) Field of Classification Search
CPC ... F01L 1/46; F01L 2001/467; F01L 13/0005; F01L 2800/12; F02D 13/0207
USPC ..... 123/90.39, 90.4, 90.41, 90.44, 90.61
See application file for complete search history.

(56) References Cited

U.S. PATENT DOCUMENTS 7,905,208 B2 * 3/2011 Ruggiero ..... F01L 1/26 123/90.22
8,225,758 B2 * 7/2012 Lee ..... F01L 13/0063 74/559
8,316,809 B1 * 11/2012 Patterson ..... F01L 13/0015 123/90.55
8,936,006 B2 1/2015 Groth et al.
2005/0061281 A1 * 3/2005 Klotz ..... F01L 13/0031 123/90.48
2005/0098135 A1 * 5/2005 Gecim ..... F01L 13/0005 123/90.59
2008/0017153 A1 1/2008 Best
2012/0067312 A1 3/2012 Lee
2012/0132162 A1 5/2012 Yoon et al.
2012/0222636 A1 * 9/2012 Gecim ..... F01L 1/185 123/90.16
2015/0240671 A1 8/2015 Nakamura
2016/0090874 A1 * 3/2016 Lee ..... F01L 1/14 123/90.16
2016/0138437 A1 * 5/2016 Lee ..... F01L 1/08 123/90.12
2020/0182097 A1 6/2020 Alexandru et al.
2020/0291826 A1 9/2020 Mandell et al.

OTHER PUBLICATIONS

Written Opinion of the International Searching Authority for International Application No. PCT/IB2021/053757 dated Jul. 13, 2021, 4 pages.

* cited by examiner

VALVE ACTUATION SYSTEM COMPRISING LOST MOTION AND HIGH LIFT TRANSFER COMPONENTS IN A MAIN MOTION LOAD PATH

FIELD

The present disclosure generally concerns valve actuation systems in internal combustion engines and, in particular, to a valve actuation system comprising lost motion and high lift transfer components in a main motion load path.

BACKGROUND

Valve actuation systems for use in internal combustion engines are well known in the art. During positive power operation of an internal combustion engine, valve actuation systems are used to provide valve actuation motions from a valve actuation motion source to one or more engine valves (either intake or exhaust valves) via a motion load path or valve train, in conjunction with the combustion of fuel, such that the engine outputs power that may be used, for example, to operate a vehicle. As used herein, a motion source is any component that dictates motions to be applied to an engine valve, e.g., a cam, whereas a motion load path or valve train comprises one or more components deployed between a motion source and an engine valve and used to convey motions provided by the motion source to the engine valve, e.g., tappets, rocker arms, pushrods, valve bridges, automatic lash adjusters, etc. Furthermore, as used herein, the descriptor "main" or "primary" refers to features of the instant disclosure concerning so-called main event engine valve motions, i.e., the valve motions used during positive power generation and the motion load path used to convey such valve motion.

Valve actuation systems may also be operated in a manner so as to cease operation of a given engine cylinder altogether through elimination of any engine valve actuations (as well as cessation of fueling), often referred to as cylinder deactivation (CDA). Such CDA systems are often operated separately on intake valves and exhaust valves such that each may be independently deactivated. Benefits of CDA include reduced fuel consumption and increased exhaust temperatures that provide for improved aftertreatment emissions control. CDA is achieved in some systems through use of a collapsing or lost motion component deployed in a motion load path capable of switching between a rigid/extended (or motion-conveying) state and a collapsed/retracted (or motion-absorbing) state. In the former state, valve actuation motions from a valve actuation motion source are conveyed via the lost motion component to the engine valve. In the latter state, the valve actuation motions are lost by the lost motion component such that the valve actuation motions are not applied to the engine valve, i.e., the engine valve remains closed. Such lost motion components are well-known in the art and often comprise a mechanical device capable of locking/unlocking or a hydraulic device capable of capturing/releasing a trapped volume of hydraulic fluid.

In systems in which CDA is implemented via a lost motion component, there are many things that can cause a failure mode of the lost motion component. Such failure modes include mechanical component failure, fatigue failure of the components, system controls error leading to inadvertent activation, debris preventing re-locking of the collapsing element, vibration, lash set error, excessive thermal growth, excessive wear of a critical element like valve seats, etc.

Additionally, there are specific operating conditions of, for example, a four-stroke engine where engine overload and possible catastrophic engine damage can occur during main event deactivation. Specifically, if a main motion load path for an exhaust valve is deactivated (whether intentionally or not), but the main motion load path for the corresponding intake valve is not, the intake main motion load path can see significant loading on the intake main event because pressure in the cylinder was not exhausted. This loading can exceed the design of the valve train even in a motoring condition and gets much worse with fuel injected. This failure mode can also cause the intake system to be exposed to excessive pressure and temperature. For example, if there is a combustion event during a power stroke that is not exhausted due to CDA mechanism failure, the combustion pressure and gasses will travel into the intake system at the subsequent intake event, causing damage to the intake system. Further still, this very high intake loading event can also cause excessive loading throughout the entire engine including the gear train and crankshaft.

To address the possibility of inadvertent or unintended CDA operation, it is feasible to design an engine system so robust that no significant damage occurs on the engine. This is more achievable on smaller-displacement engines where the loading placed on the engine in a failure mode is within the design limits of normal materials. However, such designs are much harder to realize on heavy duty engines where cylinder pressures are typically much higher.

Furthermore in automotive applications, it is known in the art to measure certain engine parameters to detect if the cylinder deactivation element has successfully locked or unlocked. In the event of a detected issue (e.g., unintended locking or unlocking), the engine controller will initiate a protection mode (sometimes referred to as "limp home" mode) where that cylinder is entirely deactivated (i.e., such that both intake and exhaust valve actuation motions are discontinued) to prevent any further engine damage.

In the realm of heavy duty engines, the "HPD" system developed by Jacobs Vehicle Systems, Inc. (as illustrated, for example, in U.S. Pat. No. 8,936,006) has a failsafe lift provided by a motion source that ensures reduced cylinder pressures to protect the valvetrain load in the event of a failed CDA element. This failsafe lift is designed to come from a separate valvetrain element, specifically an engine brake rocker arm. Additionally, U.S. Pat. No. 6,854,433 describes an auxiliary motion load path that permits at least some valve actuation despite failure of a lost motion system in the main motion load path. This system is schematically illustrated in FIG. 1, which illustrates an internal combustion engine 100 having a valve actuation system 102 that comprises a main motion load path 104 including a main valve actuation motion source 106 providing main event valve actuation motions to a rocker arm 108. In turn, the main event valve actuation motions are conveyed to one or more engine valves 114 via a lost motion system 110 and a valve bridge 112. As described above, the lost motion system 110, which comprises a standalone, hydraulically-actuated system, may be operated in a motion conveying state or a motion absorbing state. As further shown in the '433 patent, the rocker arm 108 includes an "auxiliary system" 122 in form of a projection or protuberance off of the rocker arm 108 and aligned with either the valve bridge 112 and/or one of the engine valves 114. During operation of the lost motion system in the motion absorbing state (whether intentionally or due to failure thereof), the auxiliary system 122 is configured such that at least some of the main event valve actuation motions conveyed by the rocker arm 108 are also applied valve bridge 112/valve 114, thereby ensuring opening of the valve 114 despite inoperativeness/failure of the lost motion system 110. In this manner, the auxiliary system 122 creates an auxiliary motion load path 120 that bypasses the main motion load path 104.

While the above-described solutions have proven beneficial, further developments in this area would be welcome.

SUMMARY

The instant disclosure concerns a valve actuation system comprising a valve actuation motion source configured to provide a main event valve actuation motion to at least one engine valve via a main motion load path that comprises at least one valve train component. The valve actuation system further includes a lost motion component arranged within a first valve train component in the main motion load path, the lost motion component being controllable to operate in a motion conveying state where the lost motion component conveys the main event valve actuation motion or to operate in a motion absorbing state where the lost motion component does not convey at least a portion of the main event valve actuation motion. Furthermore, the valve actuation system comprises a high lift transfer component arranged in the main motion load path, with the high lift transfer component being configured to permit the main motion load path to convey at least a high lift portion of the main event valve actuation motion when the lost motion component is in the motion absorbing state. In various embodiments, the first valve train component may comprise a valve bridge, a rocker arm or a push rod.

In an embodiment, in the high lift transfer component is incorporated in the lost motion component and, in particular embodiments, may be implemented as a stroke limiting feature in the lost motion component. In these embodiments, the lost motion component may comprise a mechanical locking subsystem or a hydraulic locking subsystem. Alternatively, the high lift transfer component incorporated into the lost motion component may be implemented as a secondary locking subsystem.

In other embodiments, the high lift transfer component is incorporated into at least one valve train component (such as a valve bridge, rocker arm or push rod) in the main motion load path and, in particular embodiments, may be implemented as a stroke limiting feature in the at least one valve train component. In these embodiments, the stroke limiting feature may comprise at least one contact surface arranged on the at least one valve train component. Alternatively, the at least one contact surface may be implemented as retractable piston, such as a hydraulically-actuated piston.

BRIEF DESCRIPTION OF THE DRAWINGS

The foregoing and other features and advantages will be discussed in detail in the following non-limiting description of specific embodiments in connection with the accompanying drawings, in which.

DETAILED DESCRIPTION OF THE PRESENT EMBODIMENTS

As used herein, any references to direction (e.g., top, bottom, upward, downward, leftward, rightward, etc.) are defined relative to the orientation illustrated in the respective drawings.

Figure 1:
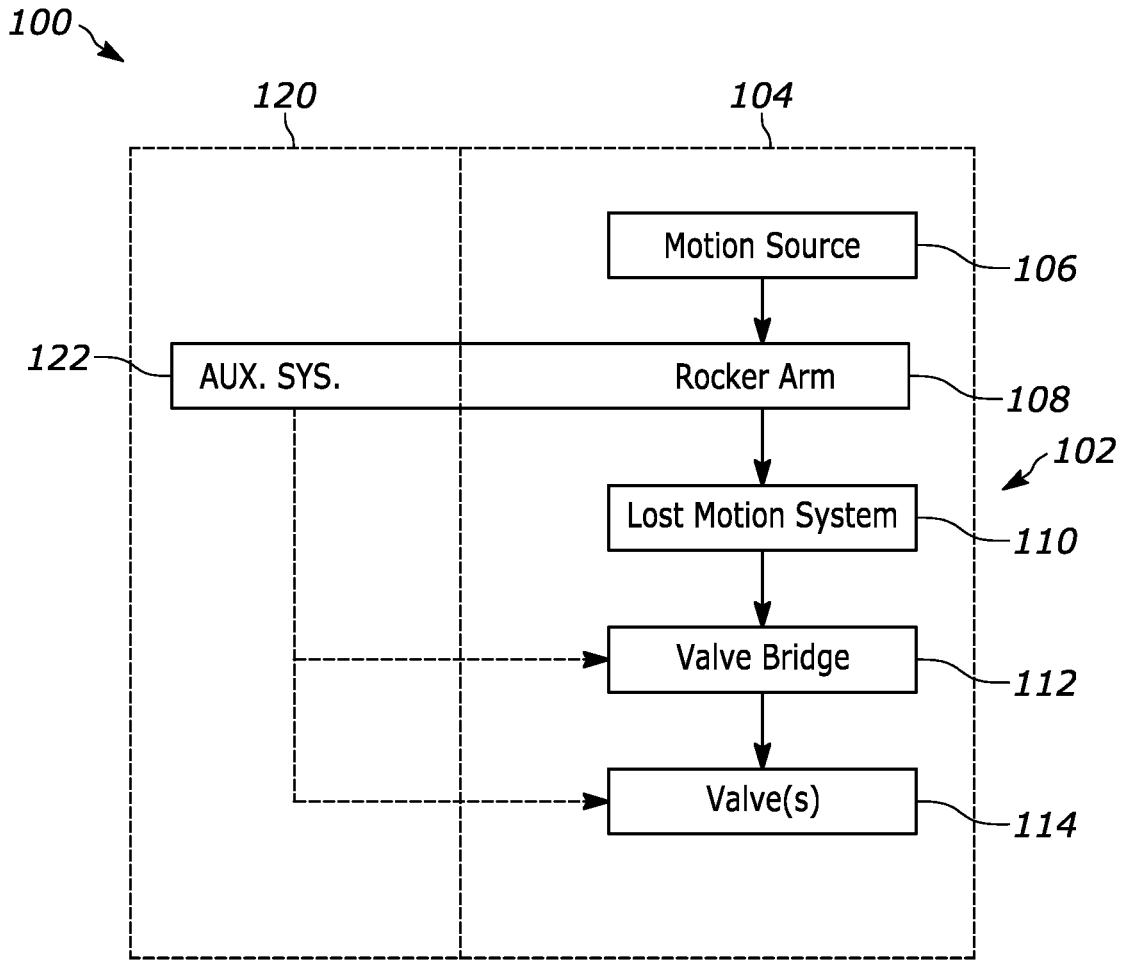
(Prior Art) FIG. 1
FIG. 1 is a schematic illustration of a valve actuation system in accordance with prior art techniques.
Figure 2:
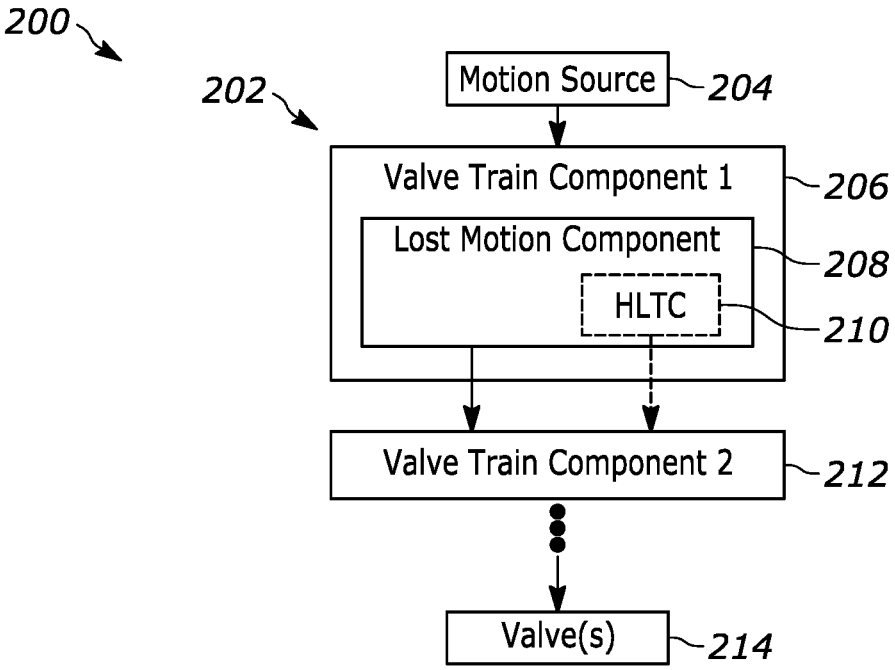
FIGS. 2 and 3 are schematic illustrations of various embodiments of valve actuation system in accordance with the instant disclosure.

Referring now to FIG. 2, an internal combustion engine 200 comprising a valve actuation system 202 in accordance with the instant disclosure is depicted. The valve actuation system 202 comprises a main motion source 204 that provides main event valve actuation motions to a first valve train component 206. In this embodiment, the first valve train component 206 comprises a lost motion component 208 arranged therein, which lost motion component 208 further comprises a high lift transfer component 210 arranged therein. As described above, the lost motion component 208 is generally capable of operation in a motion conveying state or a motion absorbing state. In turn, and as described further below, either the lost motion component 206 alone or the lost motion component 206 through operation of the high lift transfer component 210 provides at least a portion of the main event valve actuation motions to a second valve train component 212 that, in turn, provides the received valve actuation motions to one or more engine valves 214. As will be appreciated by those skilled in the art, the valve actuation systems described herein may be applied to exhaust or intake engine valves, or both. Both of the depicted valve train components 206, 212 may be any of a number of well-known valve train mechanisms, such as a valve bridge, rocker arm (either end-pivot or center-pivot types), pushrod, tappet, etc.

Collectively, the first and second valve train components illustrated in FIG. 2 constitute a main motion load path, such that incorporation of the lost motion component 208 and high lift transfer component 210 into the first valve train component 206 necessarily requires the lost motion component 208 and high lift transfer component 210 to operate entirely within the main motion load path. Additionally, though the main motion load path depicted in FIG. 2 constitutes two valve train components, those skilled in the art will further appreciate that a greater or lesser number of valve train components could be used for this purpose. Further still, while the lost motion component 208 and high lift transfer component 210 are depicted as being incorporated into the first valve train component 206 closest to the valve actuation motion source, this is not a requirement and the lost motion component 208 and its corresponding high lift transfer component 210 could be equally arranged in some other valve train component, such as the second valve train component 212, as a matter of design choice.

As used herein, the descriptor "high lift" generally refers to aspects of the instant disclosure concerning provision of any portion of a main event valve actuation motion that is greater than a lower lift threshold, which lower lift threshold is greater than zero and less than a maximum lift normally provided by the main event valve actuation motion. For example, for a main event valve actuation motion with a maximum valve lift of 15 mm, the lower lift threshold may be chosen to be arbitrarily close to, but not equal to, zero, such that the high lift portion will comprise almost the entirety of the main event valve actuation motion. On the other hand, the lower lift threshold may be chosen to be arbitrarily close to, but not equal to, the 15 mm maximum lift value, such that the high lift portion will comprise almost none of the main event valve actuation motion except for valve lift values closest to the 15 mm maximum. As this example makes evident, it is possible to set the lower lift threshold defining the high lift portion close to either extreme of the main event valve actuation motion. However, in practice, it is generally acceptable to set the lower lift threshold to a value that provides a sufficient amount of valve lift (e.g., 2 mm or more) needed to ensure at least a level of cylinder depressurization required to avoid potential damage to the engine, particularly in the case of an exhaust main event valve actuation motion, but preferably not so high as to significantly impact the air spring that is generated in CDA and known to reduce frictional and pumping losses. In this manner, the high lift portion operates as a failsafe lift in the event of unintended or otherwise erroneous CDA operation in order to avoid engine damage.

Figure 4:
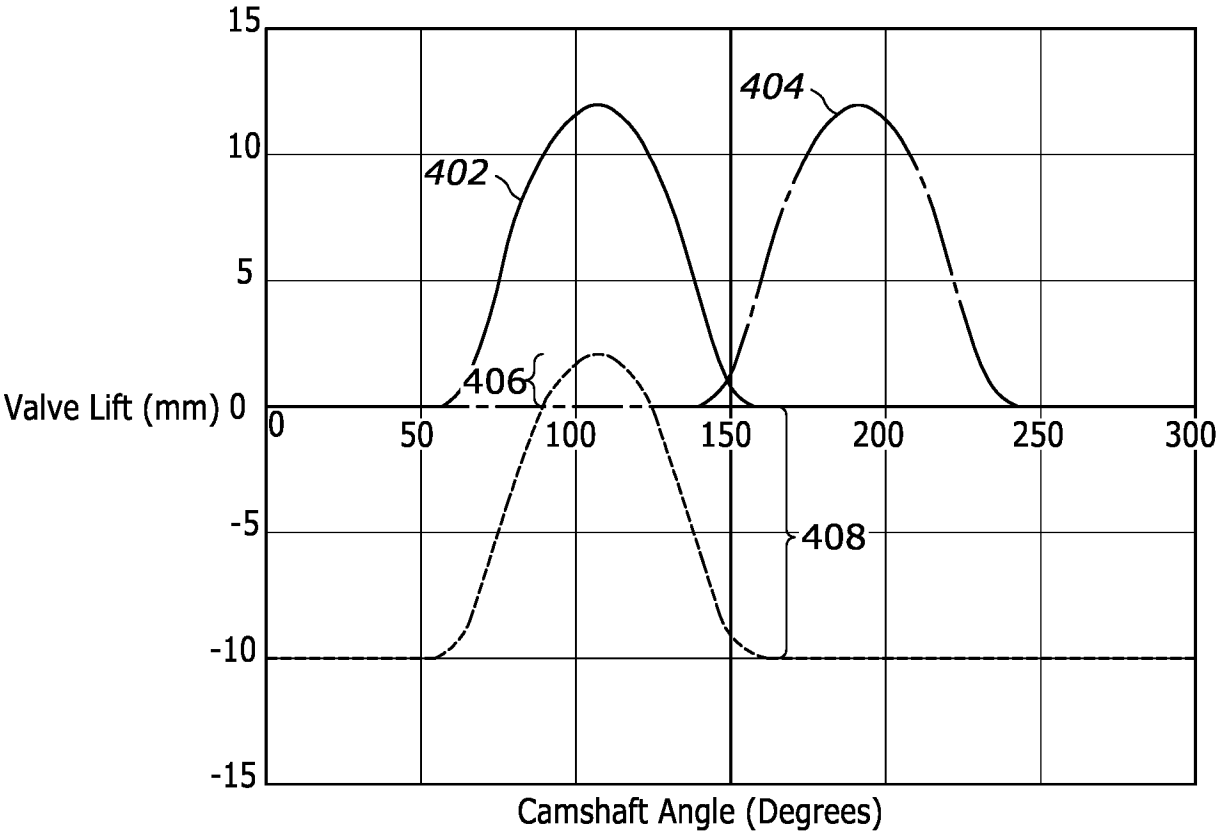
FIG. 4 is a graph illustrating exhaust and intake main events and a high lift portion of an exhaust event that is transferred by a high lift transfer component in accordance with the instant disclosure.

A specific example of a high lift portion of a main event valve actuation motion is depicted in FIG. 4, which illustrates well-known examples of main exhaust 402 and main intake 404 valve actuation motions. In this example, in which maximum lifts of approximately 12 mm are provided, and using any of the various valve actuation motion systems disclosed herein, a high lift portion 406 of approximately 2 mm is provided. That is, the lower lift threshold is set to 10 mm such that that any portion 408 of the exhaust main event 402 is lost by the lost motion component 208.

Referring once again to FIG. 2, the high lift transfer component 210 incorporated into the lost motion component 208 is configured to ensure conveyance of at least a high lift portion of the main event valve actuation motion by the lost motion component 208 when the lost motion component 208 is operating in the motion absorbing state. In various implementations described below, the high lift transfer component 210 may be implemented as either a stroke limiting feature or a secondary locking feature incorporated into the lost motion component 208. When operating in the motion conveying state, the lost motion component 208 functions to convey the main event valve actuation motions received by the first valve train component 206 to the second valve train component 212, as depicted by the solid arrow between the lost motion component 206 and the second valve train component 212. On the other hand, when operating in the motion absorbing state (whether through intentional control of such or due to the occurrence of a failure mode), the high lift transfer component 210 functions to nevertheless permit the lost motion component 206 to convey at least a portion of the main event valve actuation motions received by the first valve train component 206 to the second valve train component 212, as depicted by the dashed arrow between the high lift transfer component 206 and the second valve train component 212.

Figure 3:
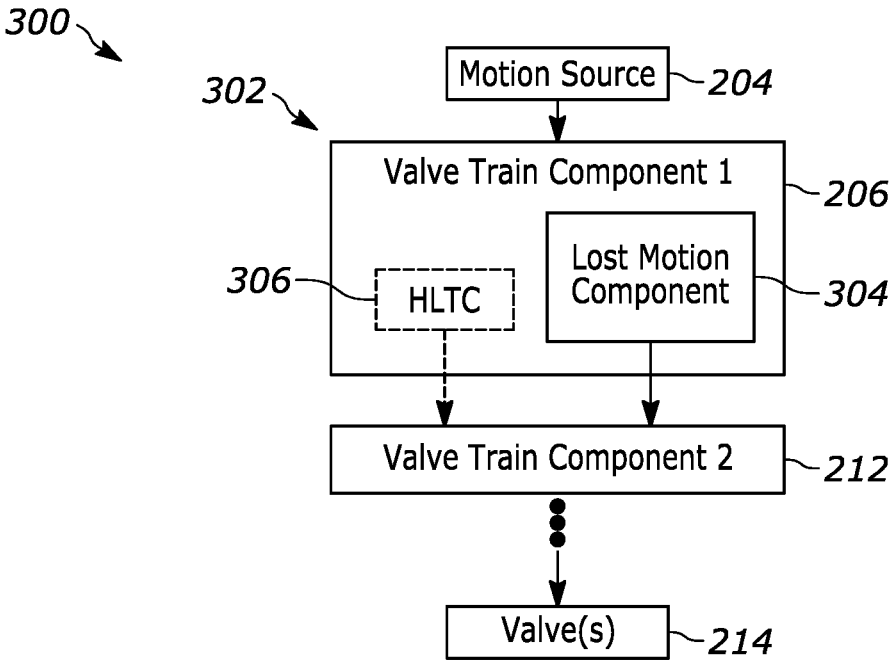

Referring now to FIG. 3, an internal combustion engine 300 comprising a valve actuation system 302 in accordance with the instant disclosure is depicted. In particular, the valve actuation system 302 is substantially similar to the system 202 depicted in FIG. 2, with the exception of the constitution of the lost motion component 304 and high lift transfer component 306 noted below. In particular, in this embodiment, the lost motion component 304 is once again incorporated into the first valve train component 206; however, the high lift transfer component 306 is not incorporated in the lost motion component 304 as in FIG. 2, but is instead also incorporated into the first valve train component 206. That is, in effect, the high lift transfer component 306 is in parallel with the lost motion component 304, as opposed to the in-line or series arrangement depicted in FIG. 2. Though shown as a feature in the first valve train component 206, it is appreciated that the high lift transfer component 306 may be implemented in a different valve train component such as the second valve train component 212. Furthermore, it is appreciated that the high lift transfer component 306 may be implemented across more than one valve train component. In various implementations described below, the high lift transfer component 306 may be implemented as a stroke limiting feature, for example in the form of contact surfaces deployed on at least one valve train component. Further still, such contact surfaces may be embodied as a retractable piston.

Figure 5:
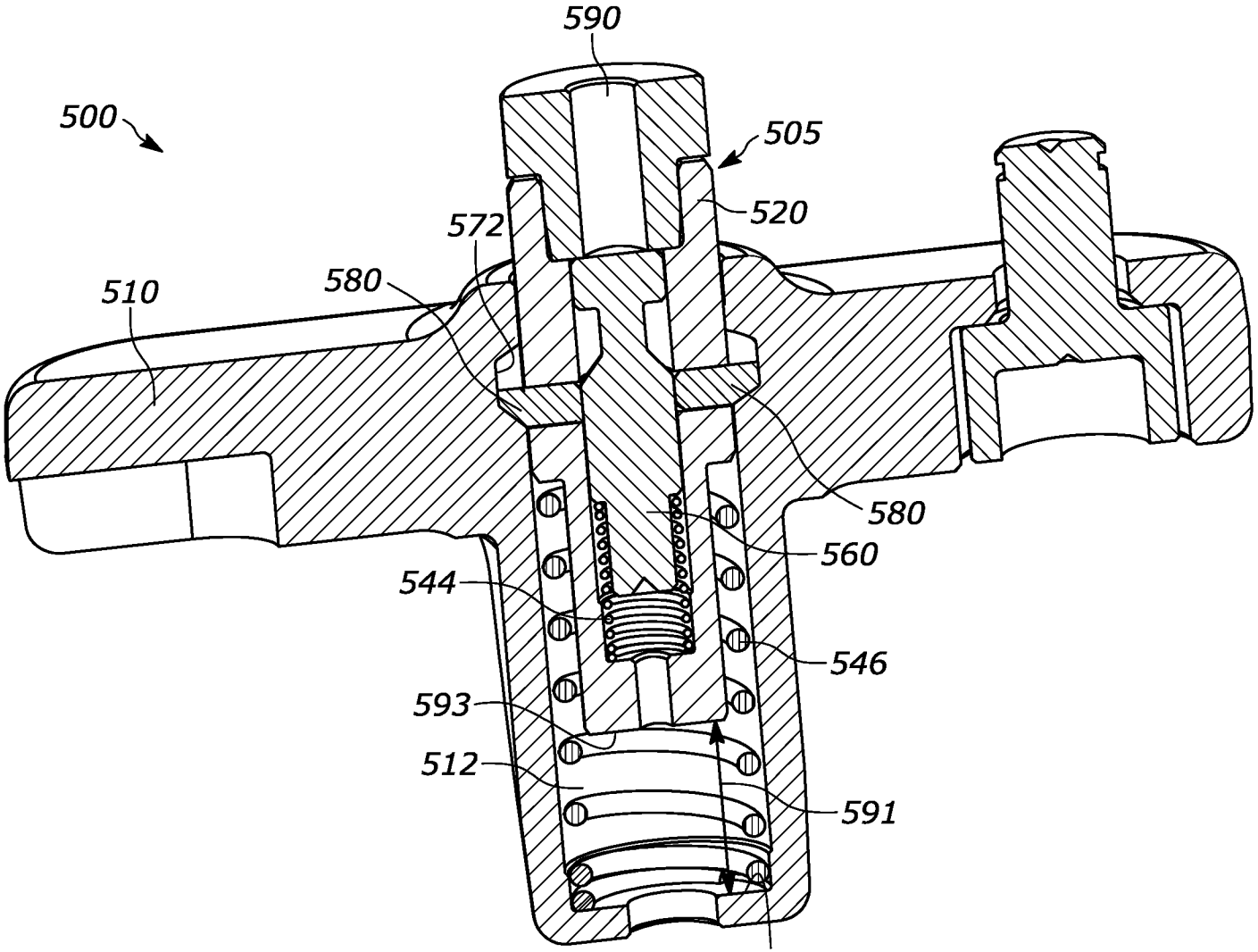
FIGS. 5-10 are cross-sectional drawings illustrating various implementations of high lift transfer components in accordance with the embodiment of FIG. 2.

FIGS. 5-10 illustrate various examples of implementations of high lift transfer components in accordance with the embodiment of FIG. 2. FIG. 5 illustrates a valve bridge 500 of the type described in U.S. Pat. No. 9,790,824. In particular, the valve bridge 500 comprises a lost motion component 505 disposed in a central bore 512 formed in a body 510 of the valve bridge 500. The lost motion component 505 comprises an outer plunger 520 slidably disposed in the central bore 512. Locking elements in the form of wedges 580 are provided, which wedges are configured to engage with an annular outer recess 572 formed in a surface defining the bore 512. In the absence of hydraulic control applied to an inner plunger 560 (via, in this case, a rocker arm, not shown), an inner piston spring 544 biases the inner plunger 560 into position such that the wedges 580 extend out of openings formed in the outer plunger 520, thereby engaging the outer recess 572 and effectively locking the outer plunger 520 in place relative to the valve bridge body 510. In this locked or motion conveying state, any valve actuation motions applied to the valve bridge 500 via the outer plunger 520 are conveyed to the valve bridge body 510 and ultimately to the engine valves (not shown). However, provision of sufficiently pressurized hydraulic fluid to the top of the inner plunger 560 via a hydraulic passage 590 causes the inner plunger 160 to slide downward such that the wedges 580 are permitted to retract and disengage from the outer recess 572, thereby effectively unlocking the outer plunger 520 relative to the valve bridge body 510 and permitting the outer plunger 520 to slide freely within its bore 512, subject to an upward bias provided by an outer plunger spring 546. In this unlocked or motion absorbing state, any valve actuation motions applied to the outer plunger 520 will cause the outer plunger 520 to reciprocate in its bore 112.

However, in this embodiment, a high lift transfer component is provided in the form of a stroke limiter having a stroke length 591 (defined by a downward-facing surface 593 of the outer plunger 520 and an upward-facing surface 595 defined by a bottom of the bore 512) that is designed to be equal to the lower lift limit described above. That is, the stroke length 591 of the outer plunger 520 is selected such that valve lifts greater than the lower lift limit will cause the outer plunger 520 to bottom out in the bore 512, thereby providing solid contact between the outer plunger 520 and the valve bridge body 510 and causing such valve lifts to be conveyed via the valve bridge body 520 to the engine valves. In this manner, the lost motion component 505 is able to provide a failsafe lift whenever the lost motion component 505 is operated in a motion absorbing state.

Figure 6:
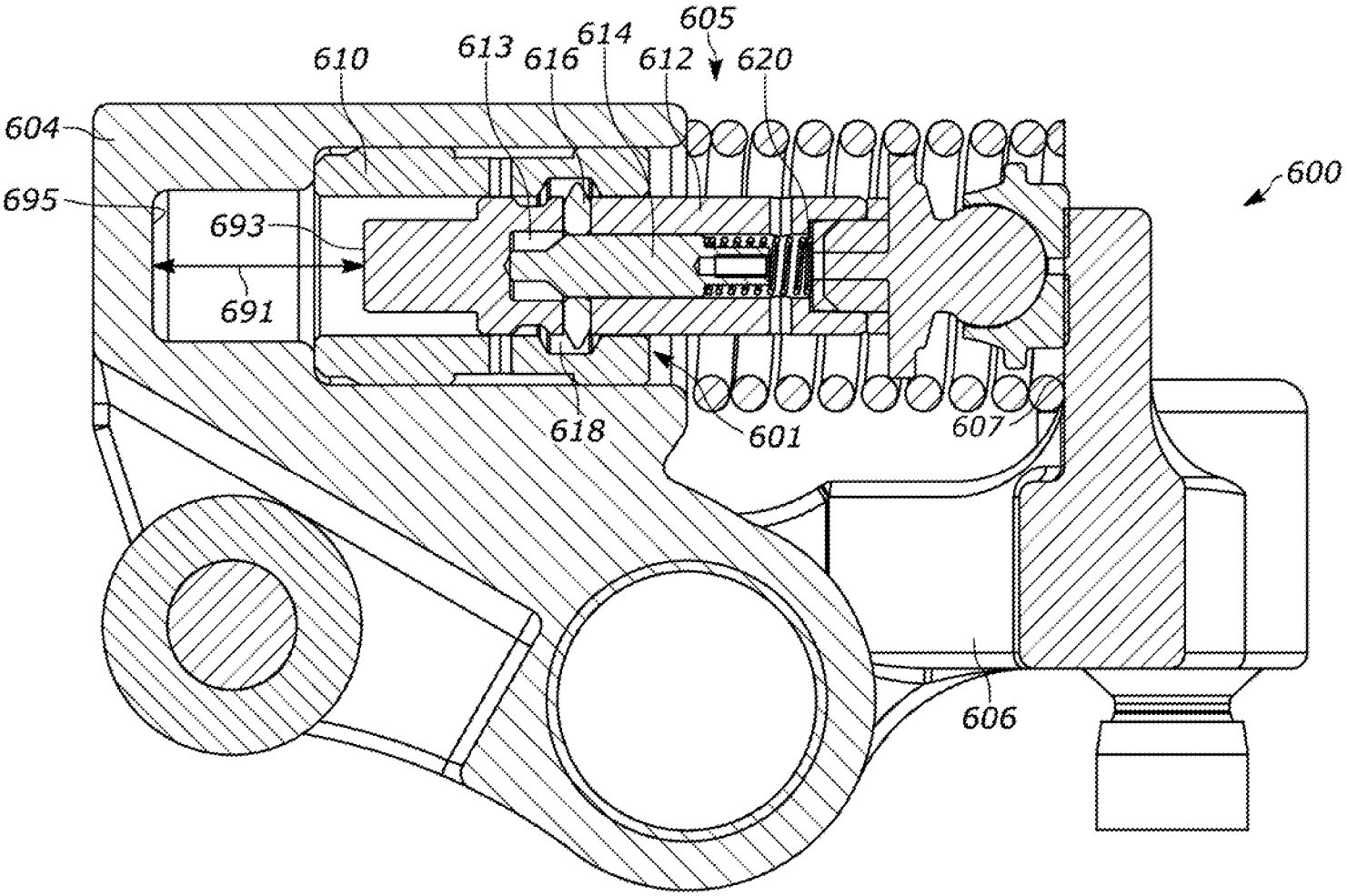

FIG. 6 illustrates a center-pivot (or Type III) rocker arm 600 of the type described in U.S. Patent Application Publication No. 2020/0182097. As shown, the rocker arm 600 comprises two half rocker arms 604, 606 having a lost motion component 605, substantially similar to the lost motion component 505 shown in FIG. 5, disposed within a bore 601 formed in a housing 610 that is, in turn, disposed in the first rocker arm 604. The lost motion component 605 establishes contact with a contact surface 607 formed on the second half rocker arm 606. In this embodiment, an outer plunger 612 is slidably disposed with the bore 601, and the outer plunger 612 also has a bore 613 with an inner plunger 614 slidably disposed therein. In the illustrated embodiment, a locking spring 620 biases the inner plunger 614 into the outer plunger bore 613. So long as the biasing force provided by the locking spring 620 is unopposed, the inner plunger 614 is biased into the outer plunger bore 413 thereby causing wedges 616 to extend through openings formed in sidewalls of the outer plunger 612 and into an outer recess 618 formed in an inner wall of the housing 610. When the locking elements 616 are extended and aligned with the outer recess 618, the outer plunger 612 is mechanically prevented from sliding within the housing bore 601, i.e., it is locked relative to the housing 610, such that, any valve actuation motions applied to first rocker arm 604 are conveyed via the lost motion component 605 to the contact surface 607 and the second half rocker arm 206, i.e., the lost motion component 605 is operated in the motion conveying state. Conversely, when hydraulic fluid pressure is applied to the outer plunger bore 613, it opposes the bias provided bias provided by the locking spring 620 and further causes the inner plunger 614 to slide out of the outer plunger bore 613. As it does so, a reduced-diameter portion of the inner plunger 614 aligns with the wedges 616, thereby permitting the wedges 616 to retract and disengage from the outer recess 618. In this state, the outer plunger 612 is permitted to slide further into the housing bore 411, i.e., it is unlocked relative to the housing 610, such that, any valve actuation motions applied to first rocker arm 604 are absorbed by the lost motion component 605 and not conveyed to the contact surface 607 and the second rocker arm 206, i.e., the lost motion component 605 is operated in the motion absorbing state.

Once again, however, in this embodiment, a high lift transfer component is provided in the form of a stroke limiter having a stroke length 691 (defined by a leftward-facing surface 693 of the outer plunger 612 and a rightward-facing surface 695 defined by a bottom of the bore 601) that is designed to be equal to the lower lift limit described above. That is, the stroke length 691 of the outer plunger 612 is selected such that valve lifts greater than the lower lift limit will cause the outer plunger 612 to bottom out in the bore 601, thereby providing solid contact between the outer plunger 612 and the first half rocker arm 604 and causing such valve lifts to be conveyed by the first half rocker arm 604, lost motion component 605 and second half rocker arm 606 to the engine valves. In this manner, the lost motion component 605 is able to provide a failsafe lift whenever the lost motion component 605 is operated in a motion absorbing state.

Figure 7:
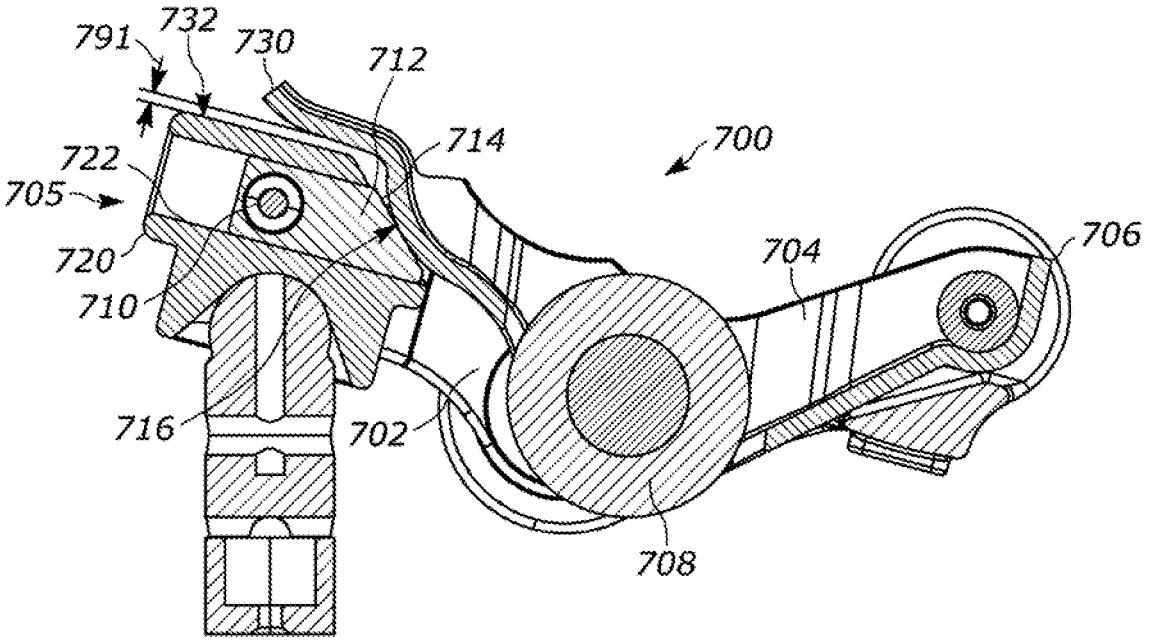

FIG. 7 illustrates an end-pivot (or Type II) rocker arm 700 of the type described in U.S. Patent Application Publication No. 2020/0291826. As shown, the rocker arm 700 comprises a lever arm 704 rotatably mounted (at a first end 706 thereof) to a rocker arm body 702. The lever arm 704 comprises curved end surface 716 opposite its first end 706. A lost motion component 705 comprises a latch 712 that is slidably disposed in a bore 722 defined in a latch boss 720 of the rocker arm body 702. The latch 712 includes a lever engaging surface 714 configured to engage the curved end surface 716 of the lever arm 704. Through operation of an actuating piston 710 having varying diameters, the position of the latch 712 within the bore 722 may be controlled such that the lever engaging surface 714 will contact the curved end surface 716 at a relatively low point thereof when the latch 712 is controlled by the actuating piston 710 to it rightmost position. This translates to a relatively elevated position of the lever arm 704 such that valve actuation motions received at the top of a roller 708 are conveyed by the lever arm 704 to the to the rocker arm body 702 and on to the engine valves (not shown). Operated in this manner, the lost motion component 705 is in a motion conveying state. Conversely, the actuating piston 710 may be operated such that position of the latch 712 within the bore 722 is controlled to its leftmost position causing the lever engaging surface 714 to contact the curved end surface 716 at a relatively high point thereof. This translates to a relatively lowered position of the lever arm 704 such that valve actuation motions cannot reach the roller 708 and are therefore not conveyed by the lever arm 704 to the to the rocker arm body 702 and on to the engine valves (not shown). Operated in this manner, the lost motion component 705 is in a motion absorbing state.

In this embodiment, a high lift transfer component is provided in the form of a stroke limiter having a stroke length 791 (defined by a downward-facing surface of a lever arm travel limiter 730 and an upward-facing surface defined by a top surface of the latch boss 720) that is designed to be equal to the lower lift limit described above. That is, the stroke length 791 of the lever arm 704 is selected such that valve lifts greater than the lower lift limit will cause the downward-facing surface of the lever arm travel limiter 730 to contact the upward-facing surface of the latch boss 720, thereby providing solid contact between the lever arm 704 and the rocker arm body 702 and causing such valve lifts to be conveyed by the rocker arm body 702 to the engine valves. In this manner, the lost motion component 705 is able to provide a failsafe lift whenever the lost motion component 705 is operated in a motion absorbing state.

Figure 8:
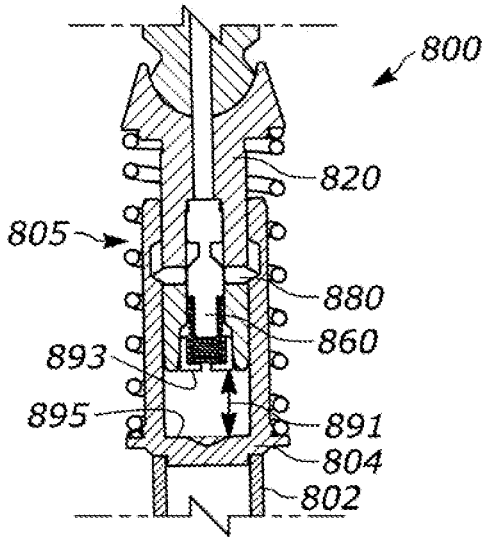

FIG. 8 illustrates a push tube 800 of the type described in U.S. patent application Ser. No. 17/247,481, assigned to the same assignee as the instant application. As shown, the push tube 800 comprises a push tube body 802 having a lost motion component 805, substantially similar to the lost motion component 505 shown in FIG. 5, mounted thereon. The lost motion component 805 includes an outer plunger 820, inner plunger 860 and wedges 880 that operate in the same manner as the identically-named components illustrated in FIG. 5, with the outer plunger 820 slidably disposed within a bore of a housing 804 that is rigidly connected to the push tube body 802. Thus, when the wedges 880 are controlled such that the outer plunger 820 is locked relative to the housing 804, valve actuation motions received via the push tube body 802 are conveyed by the lost motion component 805 to the engine valves (not shown). Operated in this manner, the lost motion component 805 is in a motion conveying state. Conversely, when the wedges 880 are controlled such that the outer plunger 820 is unlocked relative to the housing 804, valve actuation motions received via the push tube body 802 are not conveyed by the lost motion component 805 to the engine valves. Operated in this manner, the lost motion component 805 is in a motion absorbing state.

In this embodiment, a high lift transfer component is provided in the form of a stroke limiter having a stroke length 891 (defined by a downward-facing surface 893 of the outer plunger 820 and an upward-facing surface 895 defined by bottom of the housing 804) that is designed to be equal to the lower lift limit described above. That is, the stroke length 891 of the outer plunger 820 is selected such that valve lifts greater than the lower lift limit will cause the downward-facing surface 893 to contact the upward-facing surface 895, thereby providing solid contact between the outer plunger 820 and the housing 804 and causing such valve lifts to be conveyed by the lost motion component 805 to the engine valves. In this manner, the lost motion component 805 is able to provide a failsafe lift whenever the lost motion component 805 is operated in a motion absorbing state.

Figure 9:
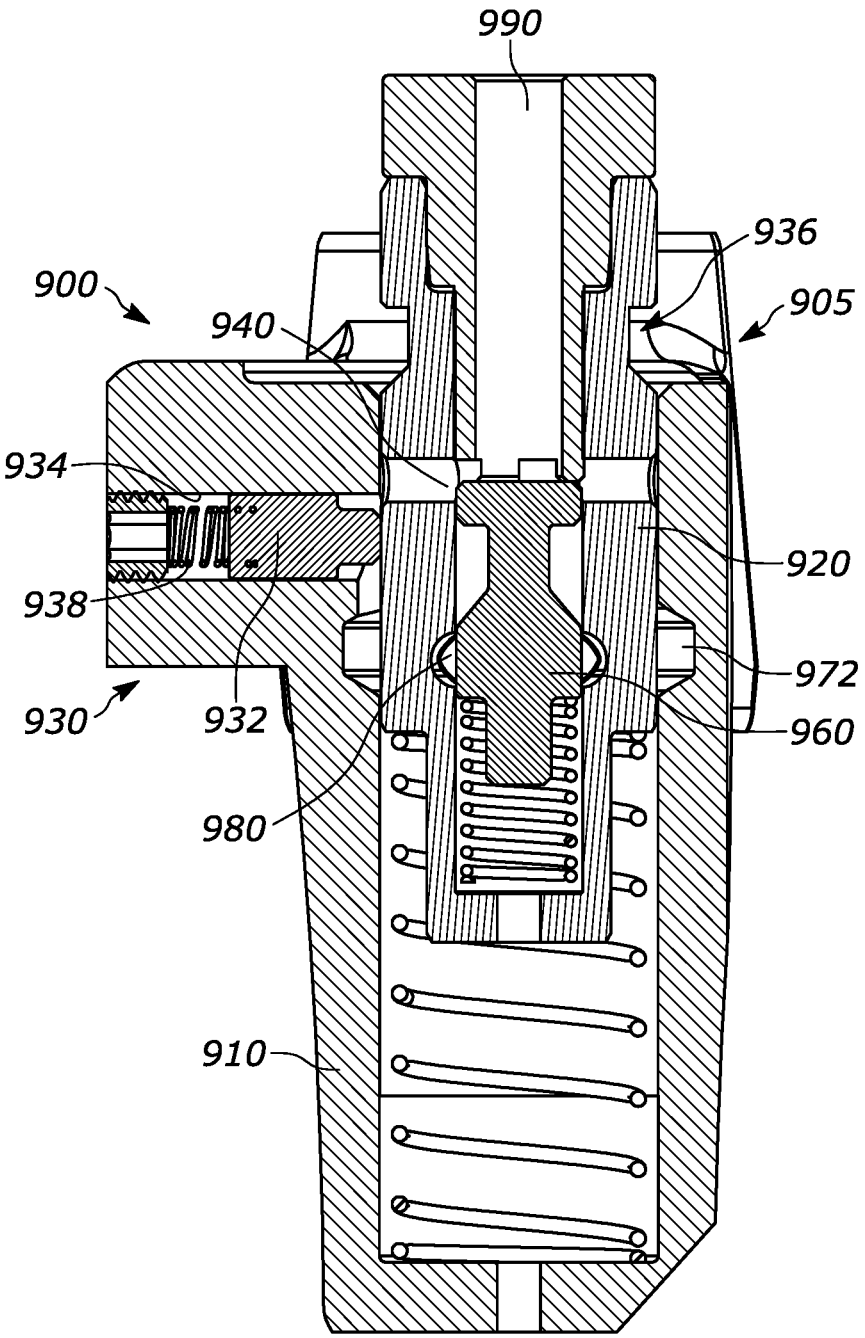
Figure 10:
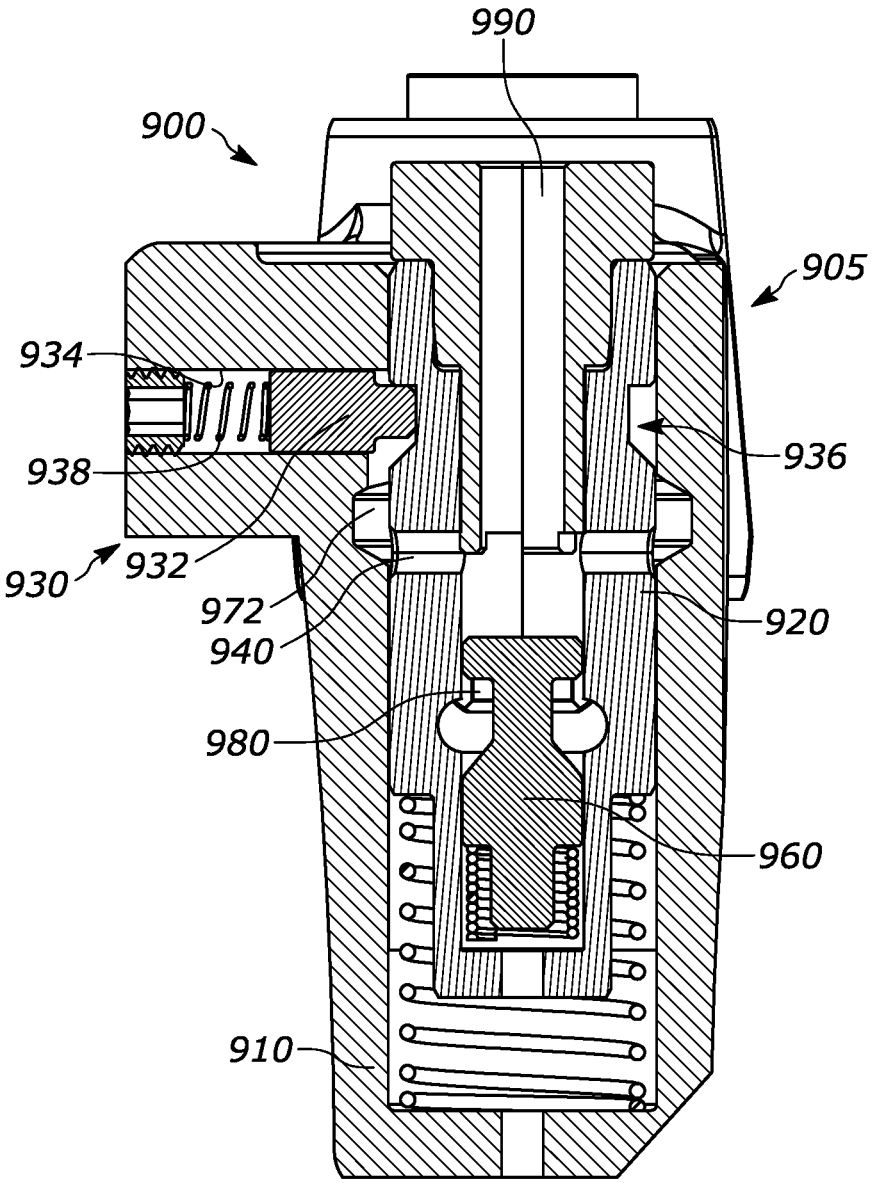

FIGS. 9 and 10 illustrate a valve bridge 900 that is substantially identical to the valve bridge 500 illustrated in FIG. 5. However, in this embodiment, the high lift transfer component is not implemented as a stroke limiting feature, but is instead provided by a secondary locking subsystem 930. In this embodiment, the secondary locking subsystem 930 is provided by the combination of a secondary locking piston 932 disposed in a secondary locking bore 934 and a locking channel 936 formed as an annulus in an outer surface of the outer plunger 920. In FIG. 9, the inner plunger 960 of the lost motion component 905 is positioned such that the wedges 980 engage the annular outer channel 972 and lock the outer plunger 920 to the valve bridge body 910. Operated in this manner, the lost motion component 905 is in a motion conveying state as during positive power generation. During the motion conveying state of the lost motion component 905, the secondary locking subsystem 930 is maintained in an unlocked state due to the lack of alignment between the secondary locking piston 932 and the locking channel 936, i.e., the secondary locking subsystem 930 does not prevent any movement of the outer plunger 920 during the motion conveying state. However, in the event the wedges 980 were to fail during the motion conveying state of the lost motion component 905, thereby allowing the outer plunger 920 to translate relative to the valve bridge body 910. In this case, the secondary locking subsystem 930 performs the failsafe function when subsequent downward translation of the outer plunger 920 (i.e., after failure of the wedges 980) permits alignment and engagement of the secondary locking piston 932 with the locking channel 936. In this condition, engagement of the secondary locking piston 932 with the looking channel 936 prevents further downward translation of the outer plunger 920, thereby effectively locking it to the valve bridge body 910. By selectively placing the locking channel 936 at a location along the longitudinal length of the outer plunger 920 reflecting the lower lift limit, the failsafe function is achieved.

When hydraulic fluid is supplied to the hydraulic passage 990 to control the lost motion component 905 to operate in the motion absorbing state (thereby permitting CDA), the presence of radial passages 940, in fluid communication with the hydraulic passage 990 and a proximal end of the locking bore 934 as shown in FIG. 9, permits the pressurized hydraulic fluid to impinge upon the secondary locking piston 932 thereby causing it to translate leftward and preventing engagement with the locking channel 936. Furthermore, and with reference to FIG. 10, the annular outer channel 972 is also in fluid communication with the locking bore 934 such that, when the outer plunger 920 has translated downward sufficiently to align the secondary locking piston 932 with the locking channel 936, the radial passages 940 also align with the annular outer channel 972, thereby continuing to permit pressurized hydraulic fluid to impinge upon the face of the secondary locking piston 932 and preventing locking engagement (not shown in FIG. 10). In this manner, commanded operation of the lost motion component 905 in the motion absorbing state (i.e., not resulting unintentionally) is permitted to proceed unimpeded, thereby also permitting complete CDA operation. In the event of a unintended loss of hydraulic pressure, the secondary locking piston 932 and the locking channel 936 will once again be permitted to engage each other, as described above, and provide the failsafe function.

Figure 11:
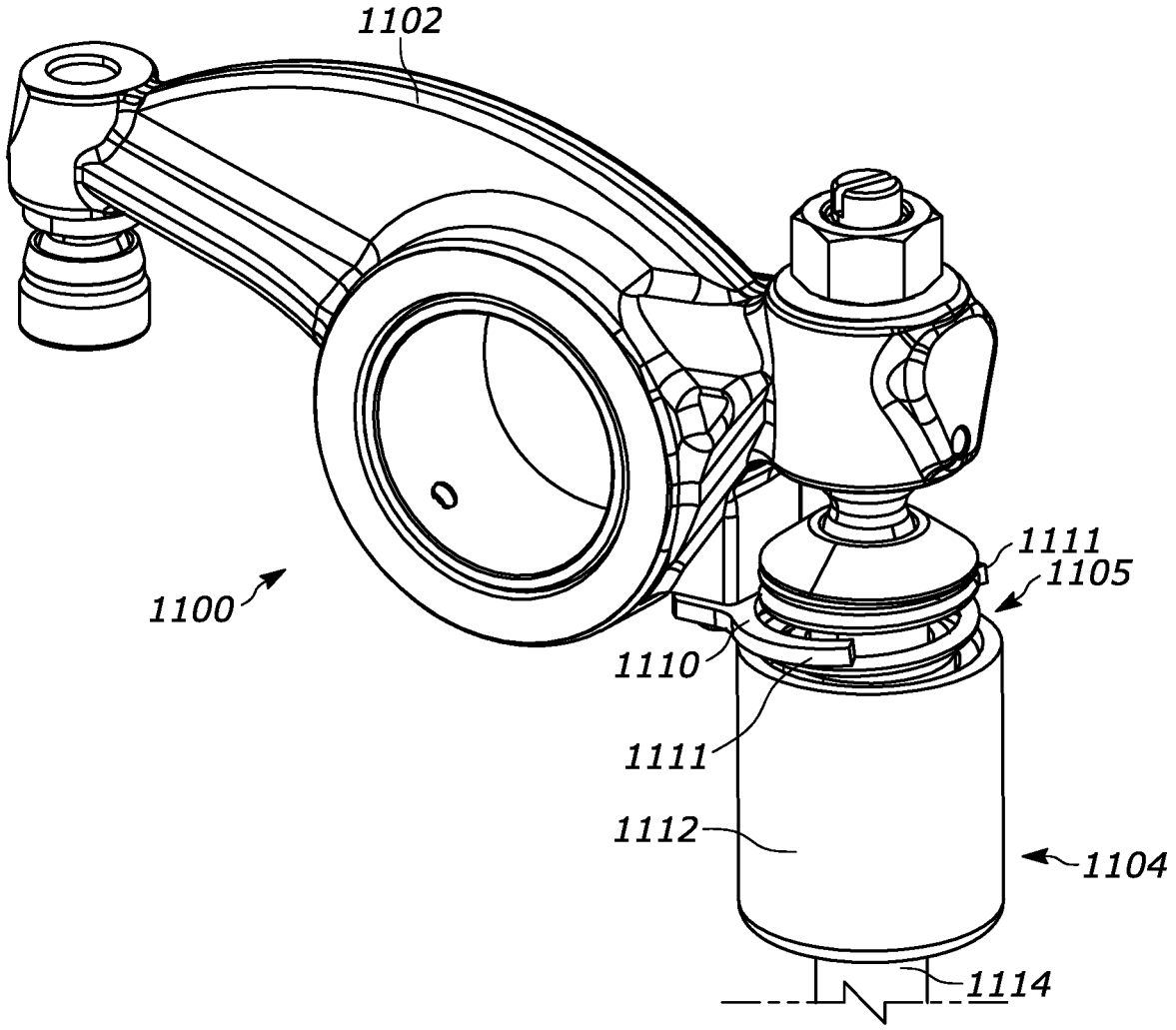
FIGS. 11-15 illustrate various implementations of high lift transfer components in accordance with the embodiment of FIG. 3.
Figure 12:
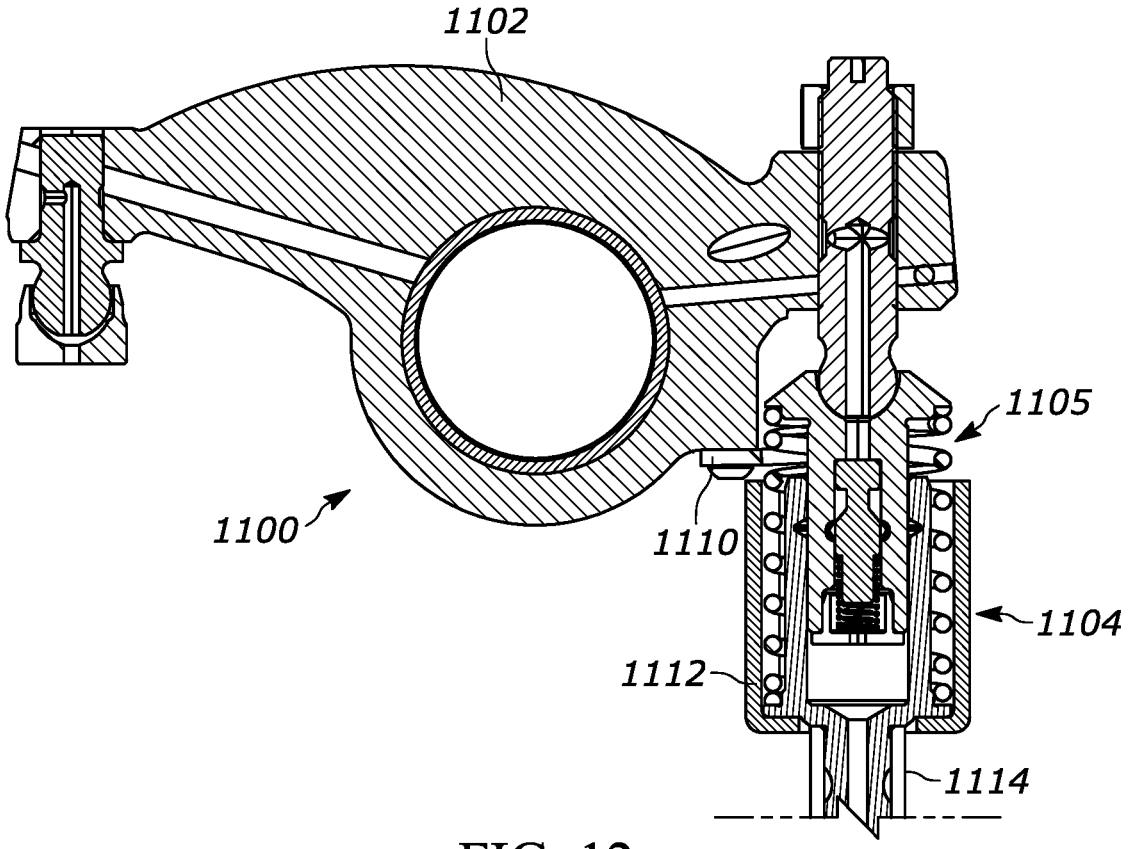

FIGS. 11-15 illustrate various examples of implementations of high lift transfer components in accordance with the embodiment of FIG. 3. FIGS. 11 and 12 illustrate a valve actuation system 1100 comprising a rocker arm 1102 the receives valve actuation motions from a push tube 1104. Like the embodiment of FIG. 8, the push tube 1104 includes a lost motion component 1105. However, unlike the embodiment of FIG. 8, the lost motion component 1105 does not include a stroke limiting feature operating as a high lift transfer component. In this embodiment, the high lift transfer component is provided by a stroke limiting feature incorporated into the two valve train components, i.e., the rocker arm 1102 and the push tube 1104. In this implementation, the stroke limiting feature is provided by the combination of a rocker arm extension 1110 and a push tube shroud 1112 surrounding the lost motion component 1105 and the stroke length is defined by spacing between the rocker arm extension 1110 and an upper surface of the push tube shroud 1112. As best shown in FIG. 11, the rocker arm extension 1110 comprises a C-ring attached to the rocker arm 1102 and configured such that the arms 1111 of the C-ring are aligned with the shroud 1112, which is attached to a push tube body 1114 of the push tube 1104. By virtue of these arrangements, when the lost motion component 1105 is operating in the motion absorbing state, the stroke length defined by the spacing between the rocker arm extension 1110 and the upper surface of the shroud 1112 is designed to be equal to the lower lift limit described above. That is, the stroke length is selected such that valve lifts greater than the lower lift limit will cause the shroud to establish solid contact with the rocker arm extension 1110 thereby causing such valve lifts to be conveyed to the rocker arm 1102 and on to the engine valves (not shown). In this manner, the valve train components in the main motion load path (i.e., the rocker arm 1102 and push tube 1104) are able to provide a failsafe lift whenever the lost motion component 1105 is operated in a motion absorbing state.

Figure 13:
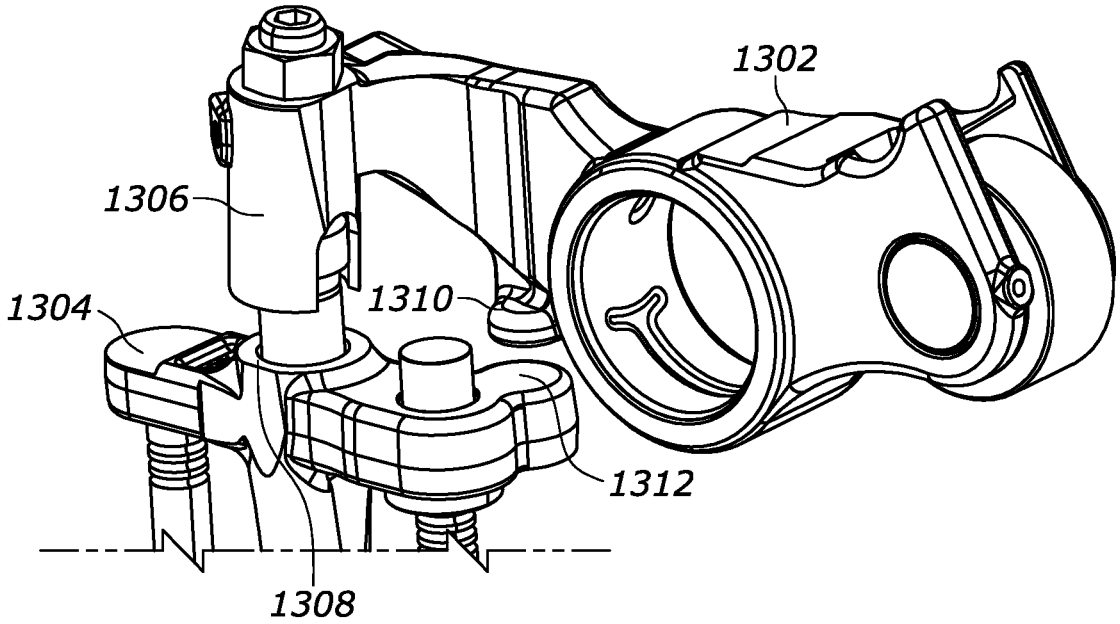

FIG. 13 illustrates two other implementations of the embodiment of FIG. 3. In this case, the main motion load path comprise a rocker arm 1302 and a valve bridge 1304. In this case, the valve bridge is substantially identical to the valve bridge in FIG. 5 with the exception, once again, that the high lift transfer mechanism is not implemented by a stroke limiting feature incorporated into the lost motion component 505. In a first of these embodiments, the high lift transfer component is provided by a stroke limiting feature incorporated into the two valve train components, i.e., the rocker arm 1302 and the valve bridge 1304. In particular, the stroke limiting feature is provided by the combination of a rocker arm shroud 1306 deployed on a nose of the rocker arm 1302 and an upper contact surface 1308 of the valve bridge 1304 such that the stroke length is defined by spacing between the rocker arm shroud 1306 and an upper contact surface 1308. By virtue of these arrangements, when the lost motion component in the valve bridge 1304 is operating in the motion absorbing state, the stroke length defined by the spacing between the rocker arm shroud 1306 and the upper contact surface 1308 is designed to be equal to the lower lift limit described above. That is, the stroke length is selected such that valve lifts greater than the lower lift limit will cause the rocker arm shroud 1306 to establish solid contact with the upper contact surface 1308 thereby causing such valve lifts to be conveyed from the rocker arm 1302 to the valve bridge 1304 and on to the engine valves. In this manner, the valve train components in the main motion load path (i.e., the rocker arm 1302 and valve bridge 1304) are able to provide a failsafe lift whenever the lost motion component in the valve bridge is operated in a motion absorbing state.

In a second of these embodiments, the high lift transfer component is once again provided by an alternative stroke limiting feature incorporated into the two valve train components, i.e., the rocker arm 1302 and the valve bridge 1304. (In practice, it would not be necessary to implement both of the stroke limiting features shown in FIG. 13; one or the other would suffice. Both are shown in FIG. 13 for ease of illustration.) In particular, the stroke limiting feature is provided by the combination of a laterally-extending rocker arm extension 1310 deployed in a valve-side portion of the rocker arm 1302 and a laterally-extending valve bridge contact surface 1312 deployed in the valve bridge 1304 and aligned with the rocker arm extension 1310 such that the stroke length is defined by spacing between the rocker arm extension 1306 and the valve bridge extension. By virtue of these arrangements, when the lost motion component in the valve bridge 1304 is operating in the motion absorbing state, the stroke length defined by the spacing between the rocker arm extension 1310 and the valve bridge extension 1312 is designed to be equal to the lower lift limit described above. That is, the stroke length is selected such that valve lifts greater than the lower lift limit will cause the rocker arm extension 1310 to establish solid contact with the valve bridge extension 1312 thereby causing such valve lifts to be conveyed from the rocker arm 1302 to the valve bridge 1304 and on to the engine valves. In this manner, once again, the valve train components in the main motion load path (i.e., the rocker arm 1302 and valve bridge 1304) are able to provide a failsafe lift whenever the lost motion component in the valve bridge is operated in a motion absorbing state.

Figure 14:
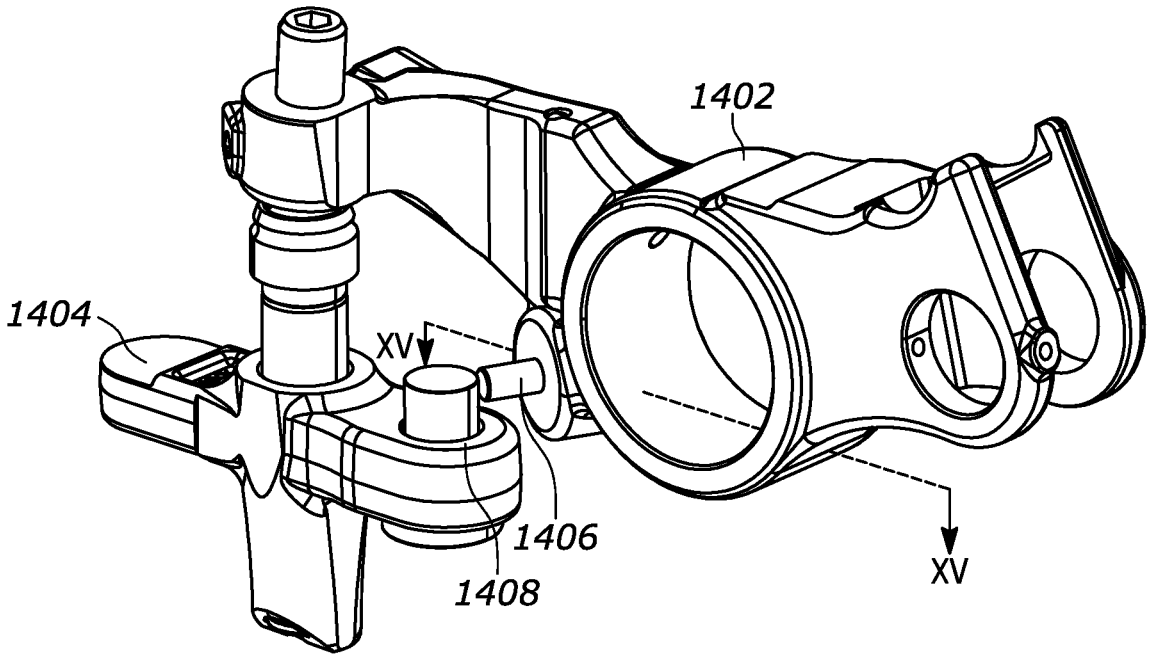
Figure 15:
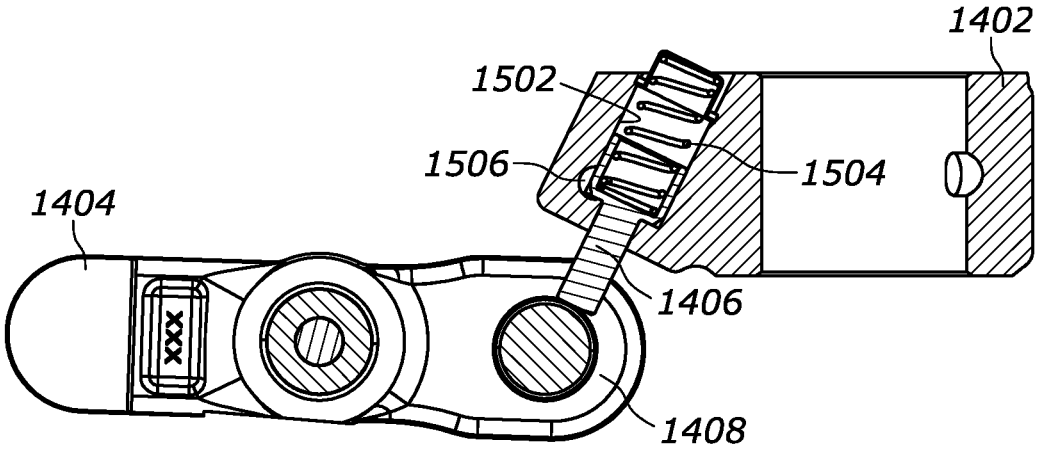

Referring now to FIGS. 14 and 15, an alternative implementation of the second embodiment shown in FIG. 13, i.e., the laterally-extending rocker arm extension, is shown, In this implementation, the laterally-extending rocker arm extension 1310 is replaced with a hydraulically-actuated retractable piston 1406, whereas the function provided by the valve bridge extension 1312 is provided by an upper surface 1408 of the valve bridge 1404. As best shown in FIG. 15, the piston 1406 is slidably deployed in a piston bore 1502 formed in the rocker arm 1402. A bias spring 1504 is provided to bias the piston 1406 out of the piston bore 1502 such that the piston 1406 is aligned with the upper surface 1408 of the valve bridge 1404. In this position, the piston 1406 and upper surface 1408 operation in substantially the identical manner as the rocker arm extension 1310 and valve bridge extension 1312 of FIG. 13. Unlike the rocker arm extension 1310 and valve bridge extension 1312, however, the piston 1406 may be retracted through provision of hydraulic fluid to the piston 1406 via a hydraulic passage 1506 formed in the rocker arm 1402. Pressurization of the hydraulic fluid against the piston 1406 sufficient to overcome the bias of the bias spring 1504 will cause the piston 1406 to retract into the bore 1502, thereby eliminating any interaction between the piston 1406 and the upper surface 1408.

Although the embodiment of FIGS. 14 and 15 has been illustrated using a hydraulically-actuated piston, it is appreciated that the retractable piston described therein may be actuated using other means known to those skilled in the art.

While particular preferred embodiments have been shown and described, those skilled in the art will appreciate that changes and modifications may be made without departing from the instant teachings. For example, while implementations of the lost motion components described herein have been primarily of the mechanical locking variety, it is appreciated that the lost motion components can instead be based on hydraulically-locked systems such as a hydraulic lash adjuster (HLA) or a control valve as known in the art. In this case, similar to the embodiment of FIG. 2, a stroke limiting feature may be incorporated into the hydraulic locking component. For example, where the hydraulic locking component is implemented as an HLA, a check ball poking feature may be provided that allows the HLA to collapse (or unlock) on demand, thereby eliminating the exhaust event. In this case, the stroke limiting feature could be designed into the HLA between the body and plunger components of the HLA. Additionally, the stroke limiting feature could be external to the HLA collapsing element in accordance with the alternative embodiment described above relative to FIG. 3.

Additionally, though the description above has been focused on provision of a high lift transfer component for the purpose of providing a failsafe lift, it will be appreciated by those skilled in the art that other advantages are provided by the teachings described herein. For example, with a CDA system it is known that under certain operating conditions pressure in a combustion chamber in the deactivated mode can achieve a negative pressure and cause oil to be sucked past the rings and consumed the combustion chamber. The teachings described herein can be used to re-balance pressure in the cylinder every cycle by allowing the high lift transfer component to open the valves to allow in intake or exhaust pressure, thereby maintaining positive pressure and minimizing oil consumption, while still allowing the engine to operate in CDA mode to achieve the other noted benefits.

Further still, though the description set forth above has discussed lost motion components and high lift transfer components in the context of CDA operation, those skilled in the art will appreciate that the instant disclosure need not be limited in that regard. For example, such components could also be applied in engine braking systems requiring discontinuation of main valve events, such as "HPD" engine brake technology developed by Jacobs Vehicle Systems, Inc.

It is therefore contemplated that any and all modifications, variations or equivalents of the above-described teachings fall within the scope of the basic underlying principles disclosed above and claimed herein.

What is claimed is:

1. A valve actuation system comprising:

a main motion load path comprising at least one valve train component;

a valve actuation motion source configured to provide a main event valve actuation motion to at least one engine valve via the main motion load path;

a lost motion component arranged within the at least one valve train component, the lost motion component configured to selective switch between (i) a motion conveying state in which the lost motion component conveys the main event valve actuation motion to the at least one engine valve, and (ii) during engine braking operation of the valve actuation system, a motion absorbing state in which the lost motion component does not convey at least a portion of the main event valve actuation motion to the at least one engine valve; and a high lift transfer component arranged to operate entirely in the main motion load path, the high lift transfer component configured to convey at least a high lift portion of the main event valve actuation motion to the at least one engine valve when the lost motion component is in the motion absorbing state.

2. The valve actuation system of claim 1, wherein the high lift transfer component is incorporated in the lost motion component.

3. The valve actuation system of claim 2, wherein the high lift transfer component comprises a stroke limiter.

4. The valve actuation system of claim 3, wherein the lost motion component comprises a mechanical locking subsystem.

5. The valve actuation system of claim 3, wherein the lost motion component comprises a hydraulic locking subsystem.

6. The valve actuation system of claim 2, wherein the high lift transfer component comprises a secondary locking subsystem.

7. The valve actuation system of claim 1, wherein the at least one valve train component comprises a valve bridge.

8. The valve actuation system of claim 1, wherein the at least one valve train component comprises a rocker arm.

9. The valve actuation system of claim 1, wherein the at least one valve train component comprises a push rod.

10. The valve actuation system of claim 1, wherein the high lift transfer component is incorporated in the at least one valve train component.

11. The valve actuation system of claim 10, wherein the high lift transfer component comprises a stroke limiter.

12. The valve actuation system of claim 11, wherein the stroke limiter comprises at least one contact surface of the at least one valve train component.

13. The valve actuation system of claim 12, wherein the at least one contact surface comprises a retractable piston.

14. The valve actuation system of claim 10, wherein the at least one valve train component comprises a valve bridge.

15. The valve actuation system of claim 10, wherein the at least one valve train component comprises a rocker arm.

16. The valve actuation system of claim 10, wherein the at least one valve train component comprises a push rod.

* * * * *